US010716345B2

(12) United States Patent
Andrews

(10) Patent No.: US 10,716,345 B2
(45) Date of Patent: Jul. 21, 2020

(54) FASHION ACCESSORY INCLUDING A CINCH CLIP

(71) Applicant: Traci Andrews, Fort Lauderdale, FL (US)

(72) Inventor: Traci Andrews, Fort Lauderdale, FL (US)

( * ) Notice: Subject to any disclaimer, the term of this patent is extended or adjusted under 35 U.S.C. 154(b) by 6 days.

(21) Appl. No.: 15/883,309

(22) Filed: Jan. 30, 2018

(65) Prior Publication Data

US 2018/0213869 A1 Aug. 2, 2018

Related U.S. Application Data

(60) Provisional application No. 62/453,627, filed on Feb. 2, 2017.

(51) Int. Cl.

| | |
|---|---|
| ***A41F 1/00*** | (2006.01) |
| ***A43C 3/00*** | (2006.01) |
| ***A43C 5/00*** | (2006.01) |
| *A43C 9/00* | (2006.01) |
| *A41B 1/00* | (2006.01) |
| *A44B 6/00* | (2006.01) |
| *A41D 15/00* | (2006.01) |
| *A44B 99/00* | (2010.01) |

(52) U.S. Cl.

CPC ..... *A41F 1/002* (2013.01); *A43C 3/00* (2013.01); *A43C 5/00* (2013.01); *A41B 1/00* (2013.01); *A41D 15/00* (2013.01); *A43C 9/00* (2013.01); *A44B 6/00* (2013.01); *A44B 99/00* (2013.01)

(58) Field of Classification Search

CPC A41B 1/00; A41D 15/00; A41F 1/002; A43C 3/00; A43C 5/00; A43C 9/00; A44B 6/00; A44B 99/00

See application file for complete search history.

(56) References Cited

U.S. PATENT DOCUMENTS

| | | | | |
|---|---|---|---|---|
| 4,261,121 | A * | 4/1981 | Coon | A47G 25/485 223/96 |
| 5,347,671 | A * | 9/1994 | Hunts | B65D 33/1675 24/30.5 R |
| 5,960,520 | A * | 10/1999 | Conway | A47C 21/022 24/306 |
| 8,443,494 | B2 | 5/2013 | Sharp | |
| 8,769,780 | B1 | 7/2014 | Segel | |
| 9,500,209 | B2 * | 11/2016 | Bonno | A45F 5/00 |
| 2002/0034992 | A1 * | 3/2002 | Tate | A63B 57/353 473/406 |
| 2006/0282993 | A1 * | 12/2006 | Dietz | A45C 11/34 24/303 |
| 2011/0252609 | A1 * | 10/2011 | Rothbaum | H01F 7/0263 24/306 |
| 2013/0219667 | A1 * | 8/2013 | Walczak | A44B 99/00 24/3.1 |

(Continued)

*Primary Examiner* — Robert Sandy
*Assistant Examiner* — David M Upchurch
(74) *Attorney, Agent, or Firm* — Laurence A. Greenberg; Werner H. Stemer; Ralph E. Locher

(57) ABSTRACT

A fashion accessory including a cinch clip is provided for altering the look of a fabric item such as an item of clothing. The accessory is removably attached to the clothing without altering or destroying the fabric item. The cinch clip of the fashion accessory can include a main body, one or more loops extending from the main body, a second body and a magnet.

13 Claims, 7 Drawing Sheets

(56) References Cited

U.S. PATENT DOCUMENTS

| | | | | |
|---|---|---|---|---|
| 2014/0250640 | A1 | 9/2014 | Crooks | |
| 2015/0305432 | A1 | 10/2015 | Wiens | |
| 2016/0309852 | A1* | 10/2016 | Krasney | A44B 6/00 |

* cited by examiner

FASHION ACCESSORY INCLUDING A CINCH CLIP

CROSS-REFERENCE TO RELATED APPLICATIONS

The present application claims benefit of Provisional Patent Application No. 62/453,627, filed on Feb. 2, 2017, entitled Cinch Clip, that application being incorporated herein, by reference, in its entirety.

BACKGROUND OF THE INVENTION

Field of the Invention

The invention relates generally to a fashion accessory and, more particularly, to a fashion accessory that includes one or more cinch clips for attachment to a garment. In one preferred embodiment, the accessory can be used to anchor materials such as parts of clothing and/or accessory items to each other and, in particular to do so using magnets that adhere to clothing or other items.

Description of the Related Art

At times, it is desirable to cinch an article of clothing to personalize it to an individual, or to better display it on a mannequin. Previously, when one wished to enclose, pinch or anchor a clothing item, loops were sewn into the clothing item, and a string was attached between the loops. When finished the loops were cut out of the fabric, which if not carefully done can destroy the garment. In addition, sewing the loops into the garment was time consuming. Furthermore, if the loops are maintained in the clothing item, they can distract from the aesthetic look of the clothing item.

U.S. Pat. No. 8,443,494 to Sharp ("Sharp") discloses a system for magnetically cinching clothing to a user, wherein the system includes a backing bar having an aperture disposed therethrough to receive a portion of clothing and an elongate concave bar receiving member that receives the backing bar. The backing bar and receiving bar are held together by magnets. In Sharp, portions of the garment can be fed through the aperture in the backing bar and pulled tightly around any area of the body. The garment portion in the aperture and/or rolled around the bar, is pinched between the bar receiving member and the backing bar of the clip system of Sharp. However, the system of Sharp is a single clip that attaches in a single location on the garment of Sharp. See, for example, FIGS. 9 and 10 of Sharp.

What is needed is a fashion accessory cinch clip or system that can attach at two points on the garment for more symmetrically gathering the garment. What is further needed is a cinch clip or system that provides loops that can be used to attach articles thereto, and which does not damage the garment to which it is attached.

SUMMARY OF THE INVENTION

It is accordingly an object of the invention to provide a fashion accessory that includes a cinch clip and which overcomes the above-mentioned disadvantages of the prior art devices of this general type. More specifically, the fashion accessory is used for altering the look of a fabric item such as an item of clothing. In particular, one or more cinch clips are removably attached to a fabric item without altering or destroying it.

With the foregoing and other objects in view there is provided, in accordance with the invention, a fashion accessory including a cinch clip. In one particular embodiment, the fashion accessory includes at least one cinch clip including a first main body, and at least one loop extending from the first main body, at least one magnet supported on the first main body, and a second main body. In a more preferred embodiment of the invention, two or more loops extend from the first main body of the cinch clip. In a further preferred embodiment, the fashion accessory includes at least two cinch clips and a string or other fastener connectable therebetween.

Other features which are considered as characteristic for the invention are set forth in the appended claims.

Although the invention is illustrated and described herein as embodied in a fashion accessory including a cinch clip, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which like reference numerals represent like items.

DETAILED DESCRIPTION OF THE INVENTION

Figure 1C:
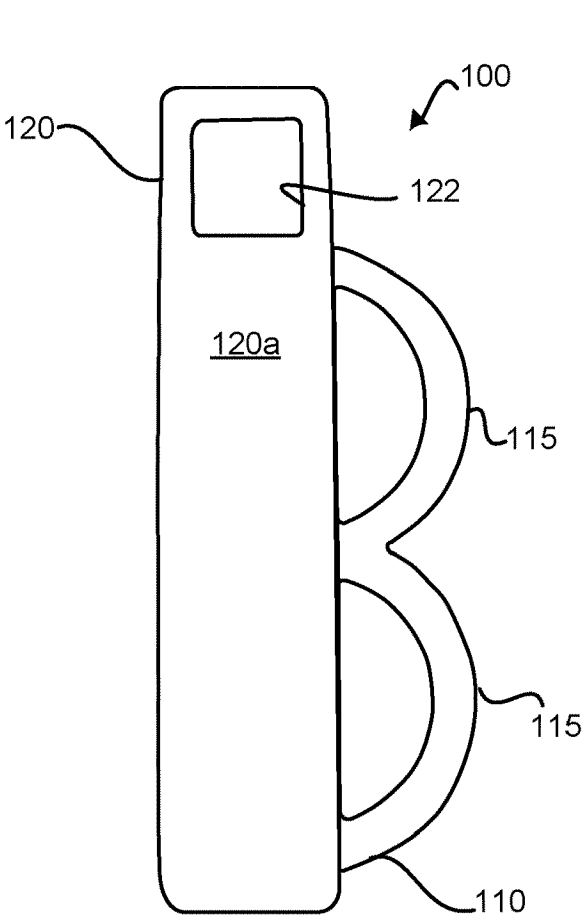
FIG. 1C is a rear plan view of the cinch clip of FIG. 1A.
Figure 1B:
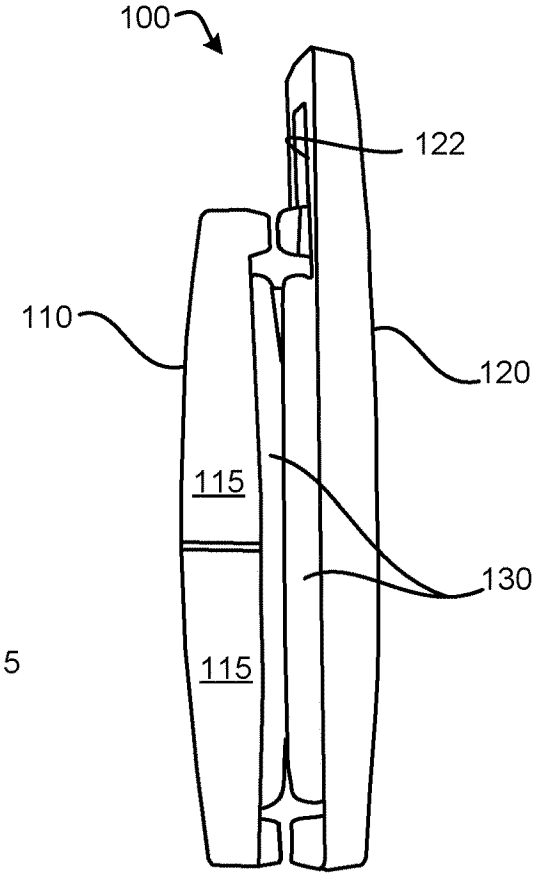
FIG. 1B is a side, perspective view of the cinch clip of FIG. 1A, viewed from the right side.
Figure 1A:
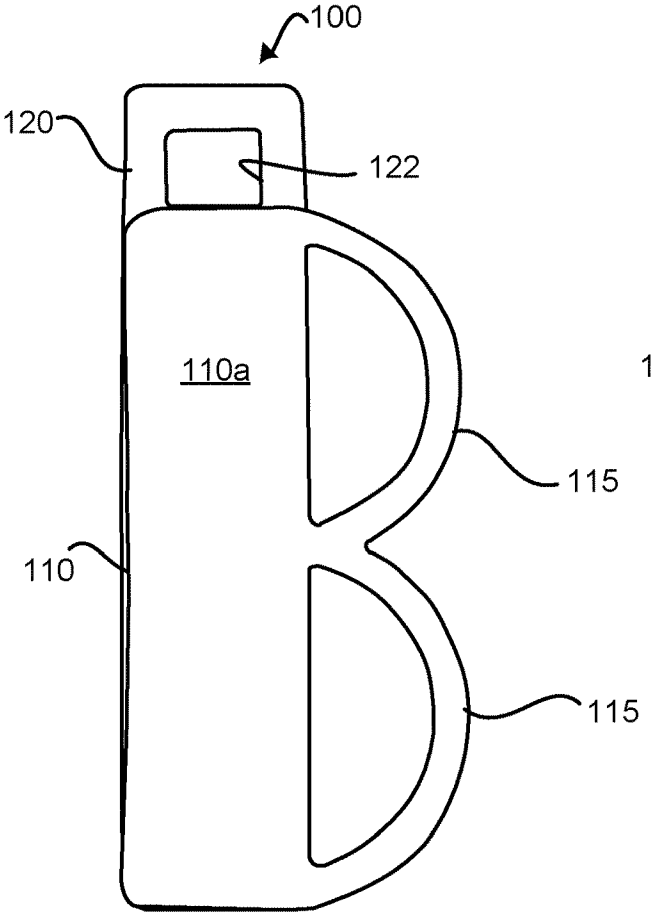
FIG. 1A is a front plan view of a of a cinch clip according to one particular embodiment of the invention.
Figure 2B:
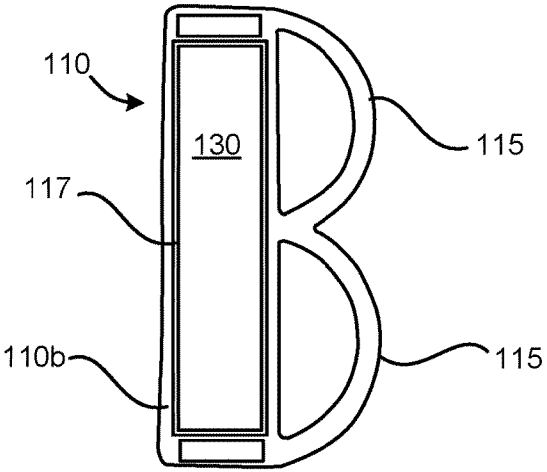
FIG. 2B is a rear plan view of the main body of FIG. 2A.
Figure 2A:
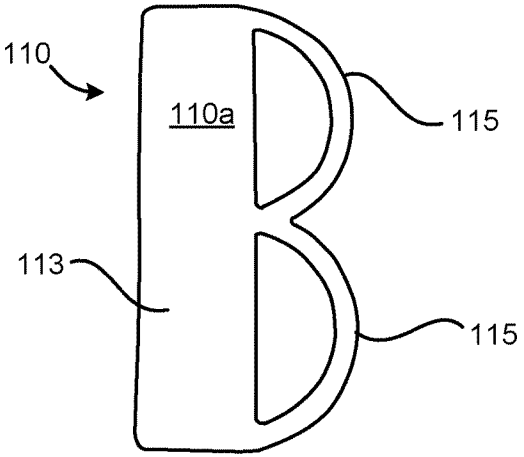
FIG. 2A is a front plan view of the clip body of a cinch clip, according to one particular embodiment of the invention.
Figure 3B:
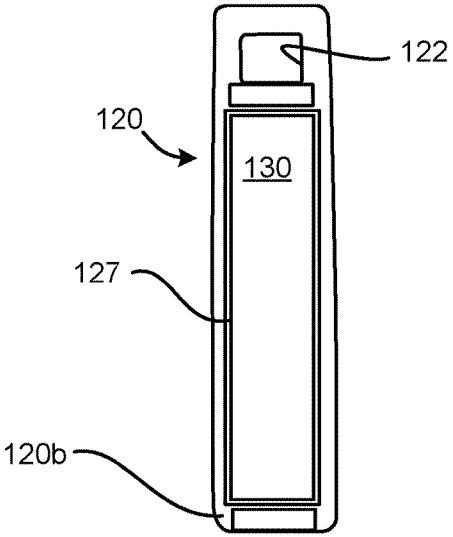
FIG. 3B is a rear plan view of the post of FIG. 3A.
Figure 3A:
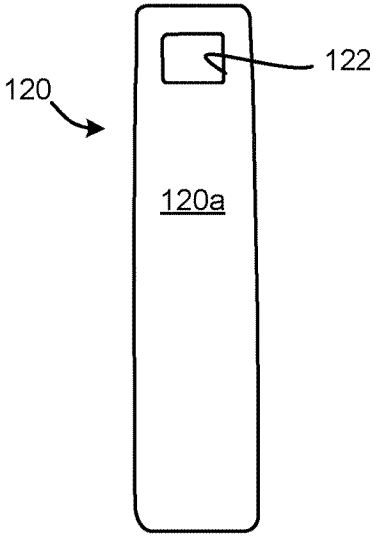
FIG. 3A is a front plan view of a post of a cinch clip, according to one particular embodiment of the invention.
Figure 5D:
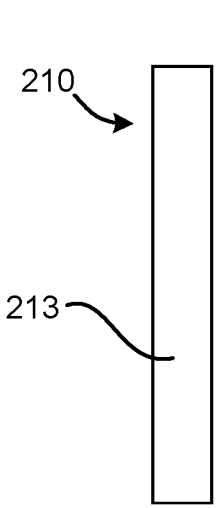
FIG. 5D is a right side plan view of the clip body of FIG. 5A.
Figure 5C:
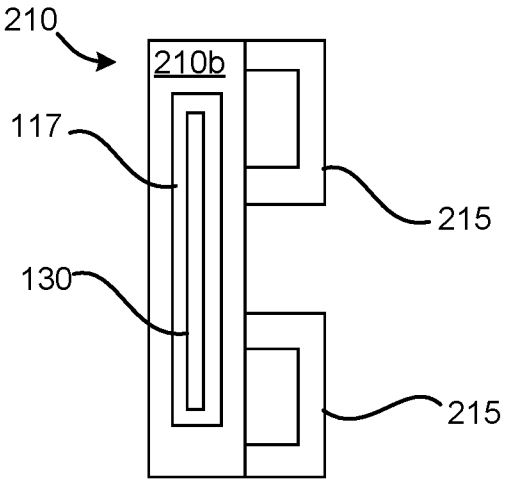
FIG. 5C is a rear plan view of the clip body of FIG. 5A.
Figure 5B:
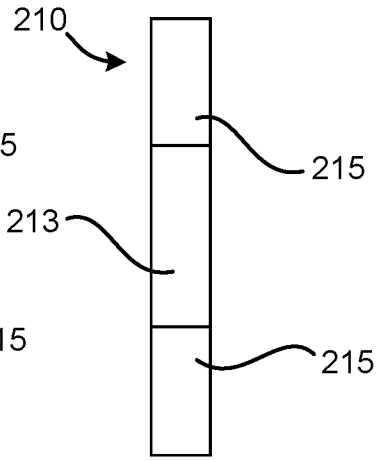
FIG. 5B is a right side plan view of the clip body of FIG. 5A.
Figure 5A:
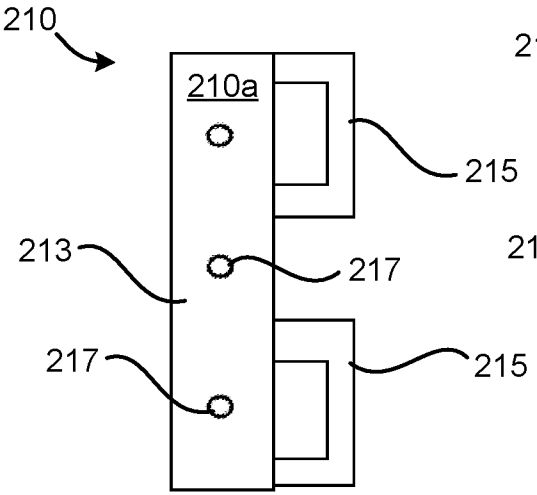
FIG. 5A is a front plan view of a clip body in accordance with another embodiment of the present invention.

The present invention provides a fashion accessory that includes one or more magnetic cinch clips for use in customizing garments for fit and/or appearance. Referring more particularly to FIGS. 1A-3B, there is shown a cinch clip 100 in accordance with one particular embodiment of the present invention. Each cinch clip 100 is configured as two main, separable parts: a first body or clip body 110; and an elongated post 120. In one embodiment of the invention, the cinch clip 100 is configured to be reversible, and as such, each of the first body 110 and post 120 have a finished face 110*a*, 120*a*, that faces out from the cinch clip 100 when the two parts 110, 120 are mated together. Opposite each finished face 110*a*, 120*a*, is a back side 110*b*, 120*b*, which back sides are configured to face when another, when the two parts 110, 120 are mated together. In one embodiment of the invention, a magnet 130 is attached to the back side of at least one of the first body 110 and the post 120. If the other of the first body 110 and post 120 is made of metal, only the one magnet may be used. In one particular embodiment of the invention, a magnet is provided on the back side of each of the first body 110 and post 120, as illustrated in FIGS. 1B, 2B and 3B, in complementary fashion (i.e., having opposite poles), so that the first body 110 and post 120 are strongly attracted to one another and held together when mated, as illustrated in FIGS. 1A-1C, even when fabric separates the first body 110 from the post 120.

The post 120 of the present embodiment additionally includes a loop formed by an aperture 122 through the post 120, which, when the post 120 is worn facing out from the garment, can be used to hang a charm or decorative article from the post 120. However, it should be understood that the aperture 122 can be omitted, if desired. Additionally, although illustrated as being square, apertures of other shapes can be provided in the post 120.

Each clip body 110 of the cinch clip 100 is illustrated as having a rectangular base 113, which may be made of any material, as desired (e.g. metal, plastic, composite bar, wood, etc.). In the preferred embodiment, the loops extend from the base 113 perpendicular to a longitudinal axis through the rectangular base 113, and are not formed in the base 113, or collinear with the longitudinal axis extending through the base 113. The illustration of a rectangular base 113 is not meant to limit the invention only thereto, as any functional arbitrary shape is possible for the base 113 in keeping with the scope and spirit of the present invention. In the preferred embodiment of the invention, one or more loops 115 are formed with, or otherwise attached to, the base 113. The loop 115 is provided for securing a material to the body 110. In a preferred embodiment, two or more loops 115 are provided. The loops are used, in one embodiment, for passing an elongate tying material (160 of FIGS. 6 and 7), such as yarn, string, thread, leather thong, etc., therethrough and/or tying the material thereto. For example, when two or more cinch clips 100 are used together, the material may be used to tie the two or more cinch clips 100 together, when fixed to a garment, so as to adjust and fix the distance between the cinch clips 100 and, correspondingly, the amount of cinching or gathering of the material between the cinch clips 100, as will be discussed more particularly in connection with FIGS. 6 and 7, below.

In the preferred embodiment illustrated in FIGS. 1A-3B, the loops 115 are illustrated as being semi-circular, however it is not meant to limit the loops 115 to only a semi-circular shape. Rather, the loops 115 can have other shapes, such as square, triangular, rectangular or other geometric shapes, as desired. For example, referring now to FIGS. 5A-5D, a clip body 210 is shown as having loops 215 configured in a half square design, extending from the base 210*a* of the clip body 210. The clip body 210 is configured to mate with a post, such as post 120 described herein. It should be understood that a cinch clip can be designed with 1, 2, 3, 4, 5 or even more loops, without departing from the scope or spirit of the present invention.

Further, in one particular embodiment of the invention, the body 110 of the clip 100 is about 1⅛ inches in length and about ⅝ inches in width, at its widest point, while the post 120 is about 1½ inches in length and 5/16 of an inch in width. However, it is not intended that the invention be limited only to a clip having the foregoing dimensions, as other clip sizes can be used without departing from the scope and spirit of the present invention.

Referring now to FIGS. 1A-7, It should be recognized that many different geometric loop designs are possible, as the loops 115, 215 merely have to be shaped for receiving the tying material therethrough. Additionally, it is preferable that the loop 115, 215 be closed, so that the tying material does not slip out from the loop 115, 215 when passed therethrough. The body 210 will be paired with a post 120, as described in connection with the embodiment of FIGS. 1A-4, to form a cinch clip in accordance with one particular embodiment of the invention.

For aesthetic or decorative purposes, one or more decorations 217, which may be one or more of a design, emblem, gemstone or charm, may be provided on one or both of the front face 110*a*, 210*a* of the clip body 110, 210 and/or the front face 120*a* of the post 120. The decoration 217 may be of any shape and is generally illustrated herein as a circle 217. However, any decorative piece or design may be used for the decoration 217, such as, for example, a gem stone. Additionally, one or more of the loops 115 and/or the loop formed by the aperture 122 can be used to hang a charm or other hanging decoration therefrom, if desired.

In the present preferred embodiment, in order to ensure that the clip body 110, 210 mates with the post 120, a recess 117 is provided in the back face 110*b*, 210*b* of the clip body 110, 210 and configured to receive a magnet 130. Similarly, in the present preferred embodiment, the back face 120*b* of the post 120 includes a recess 127 that receives a magnet 130. Note that, if desired, the recess 117 and/or recess 127 may be omitted, and the magnet(s) secured directly to the rear face 110*b*, 210*b*, 120*b* of the respective part using a cement or adhesive. In a preferred embodiment, the magnets 130 are permanently affixed to the body 110 and/or post 120.

Figure 4:
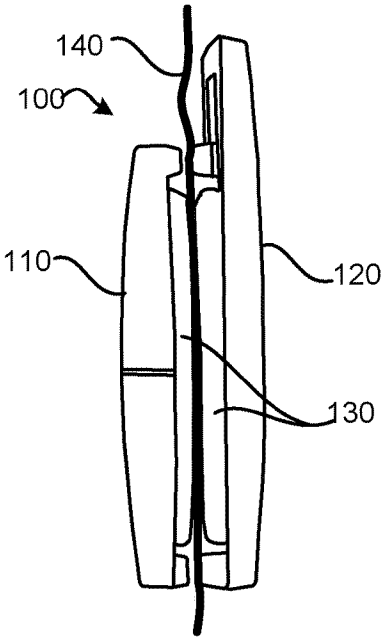
FIG. 4 is a is a side, perspective view of the cinch clip according to one particular embodiment of the invention, having a piece of fabric between the clip body and the post.

The magnets are mounted in the clip body 110/210 and post 120 in a complementary fashion, so that the body 110 or 210 and post 120 attract one another, rather than repelling one another. In one particular embodiment of the invention, rare earth magnets are used as the magnets 130, to provide a strong attraction and holding force between the clip body 110 or 210 and the post 120, even with a piece of fabric or clothing 140 in-between, as illustrated in FIG. 4. In this manner the piece of fabric 140 is gripped by the cinch clip 100 without being damaged, as is required with pins and direct material sewing. Thus, as illustrated in FIGS. 4 and 7, the cinch clip 100 includes a clip body 110 (or 210, as desired) and a post 120, wherein the clip body 110 is provided on one of the inside or outside of the side of the garment 140 and the post 120 is provided on the other one of the inside or outside of the garment, to secure the cinch clip 100 to the garment. Alternately, as illustrated in FIG. 6, both parts 110, 120 may be on the outside face of the garment 140, but a piece of garment 140 may be folded over, with the post 120 on one side (i.e., inside or outside) of the fold 144 and the clip body 110 on the other side of the fold 144.

As discussed above, each part 110/210 and 120 may include a magnet 130, as illustrated. Alternately, if desired, one of the clip body 110/210 or the post 120 can include a magnet, while the other is made of a magnetically attractive material, such as iron. In this alternate embodiment, the body 110/210 and post 120 would be held to each other due to the magnetic attraction between the magnet 130 on the one part 110/210 or 120 and the magnetically attractive material of the other part 110/210 or 120.

Figure 9:
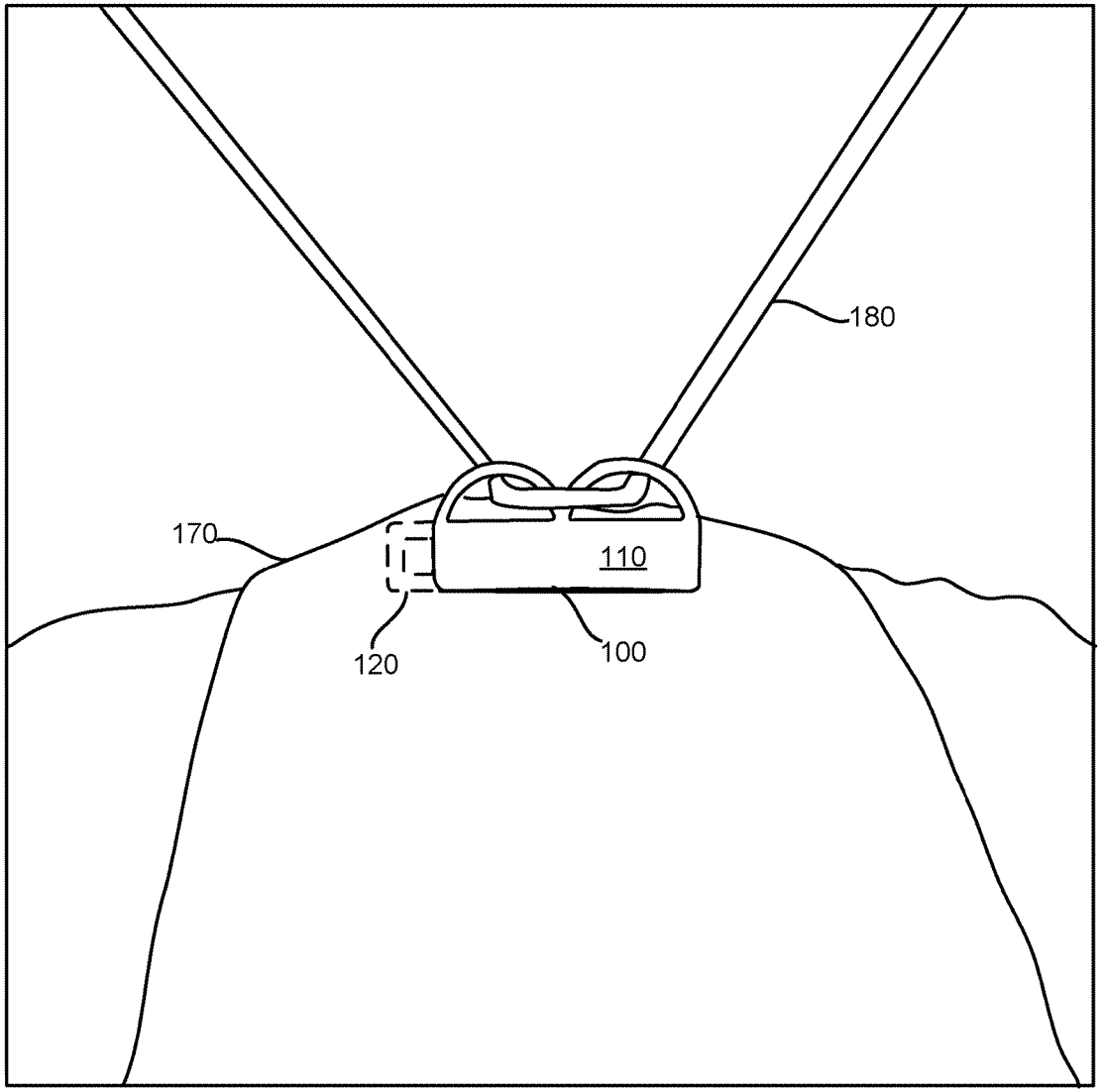
FIG. 9 illustrates a fashion accessory including a single cinch clip, positioned sideways, to hold up a scarf or a strapless garment, via a neck strap laced through loops of the clip, in accordance with another particular embodiment of the invention.

The cinch clip 100 can be used, alone, if desired, to gather a scarf or belt or to affix a charm or decoration to a garment. Additionally, a fashion accessory of one preferred embodiment of the invention can include an elongated tying material and only one cinch clip 100, 200. For example, referring now to FIG. 9, a single cinch clip 100 can be used sideways to create shoulder straps or a connection point for a neck strap 180 (laced through the loops 115) for holding up a scarf 170 fashioned as a top or dress worn by a user. A cinch clip 100 can be further used on the center of a bra to create a unique neckline, or to create belts, tops, and dresses or make anything form fitting In accordance with one particular embodiment of the invention, a fashion accessory is provided that uses two or more cinch clips 100, in combination. Referring now to FIGS. 6 and 7 of the instant application, two particular embodiments of a fashion accessory are illustrated in which a pair of cinch clips (100 of FIG. 6; 200 of FIG. 7) are used on fabric 140 or garment 240. It should be understood that, for purposes of explanation, the two described embodiments of cinch clips 100, 200, and/or cinch clips having other geometric shapes, as discussed herein, can be substituted for one another and used interchangeably for one another.

Figure 6:
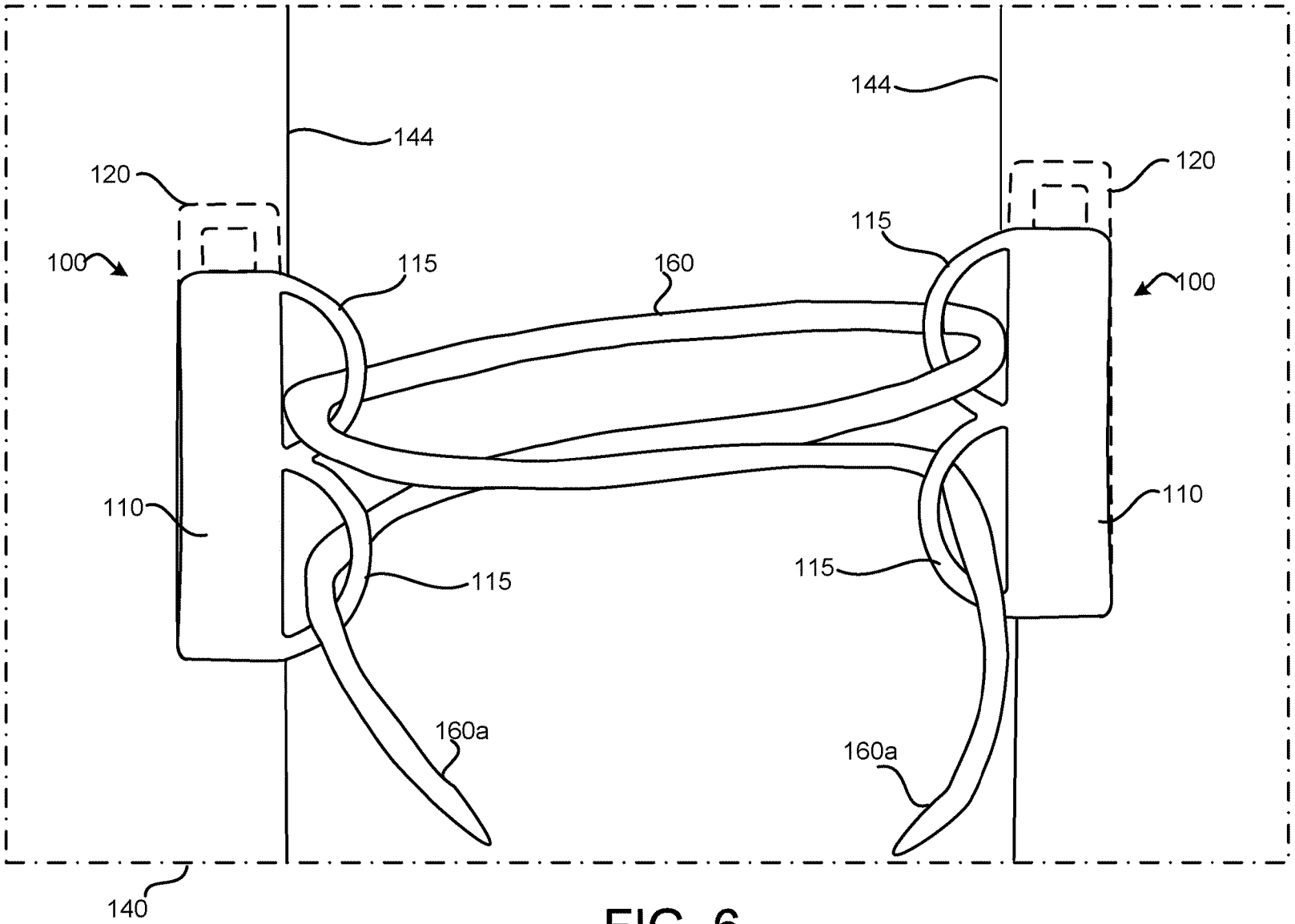
FIG. 6 illustrates a fashion accessory including at least two cinch clips attached to a garment, in accordance with one particular embodiment of the invention.
Figure 7:
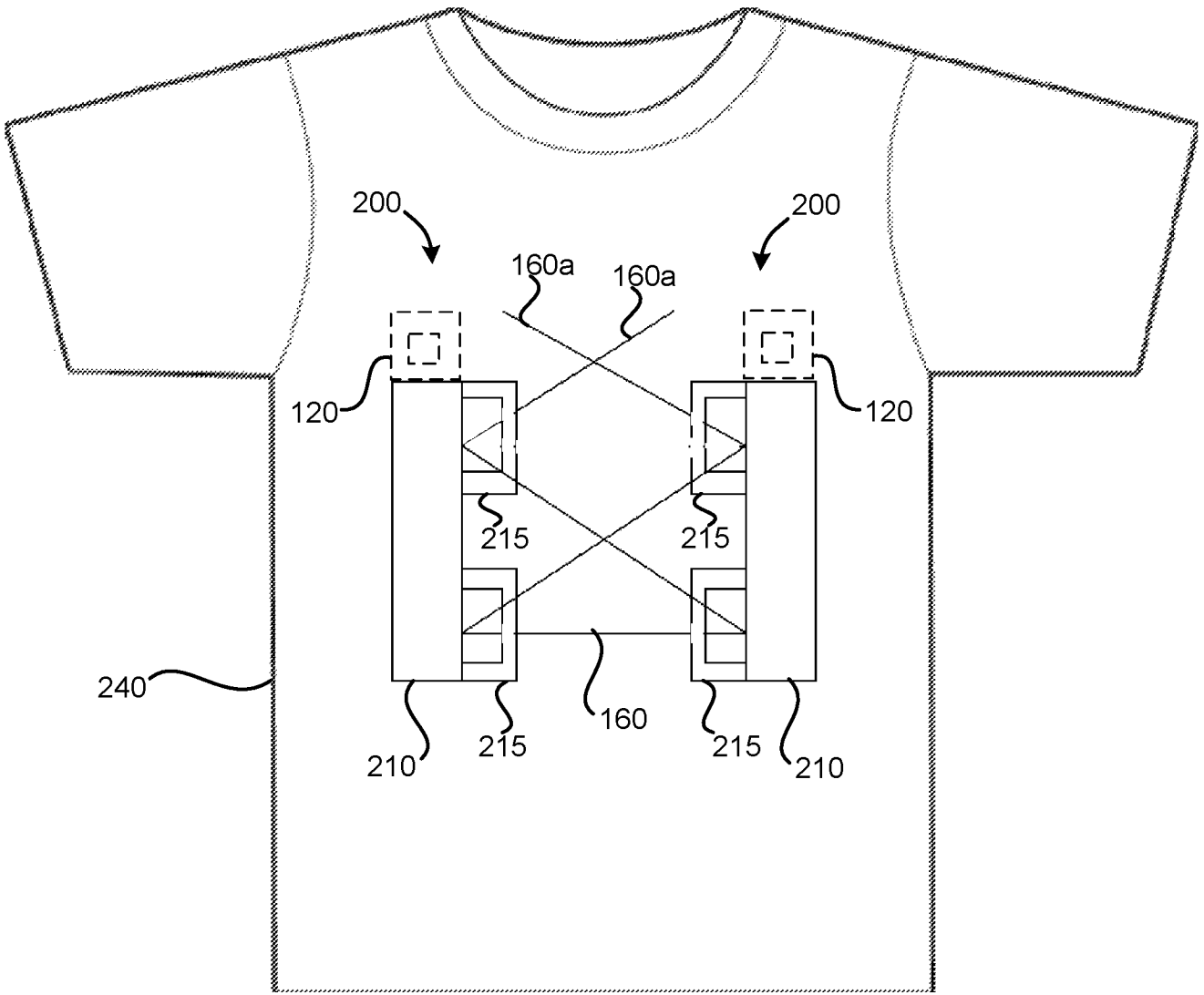
FIG. 7 illustrates a fashion accessory including at least two cinch clips attached to a garment, in accordance with another particular embodiment of the invention.

The particular embodiment of a fashion accessory of FIGS. 6 and 7, in addition to a pair of cinch clips, additionally include an elongate tying material 160 extending between the loops (115 of FIG. 6; 215 of FIG. 7) of the pair of cinch clips 100, 200 for closing or scrunching (i.e., cinching) the fabric 140 or garment 240 between the cinch clips 100, 200, respectively. For example, referring now to FIG. 7, two (or more, if desired) cinch clips 200 can be clamped onto fabric of garment 240 by attaching the looped cinch body 210 to the outside of the fabric, and the post part 120 to the inside face of the fabric (i.e., the inside of the garment or the inside face of a pleat or fold of the fabric), and lacing an elongated tying material 160 (i.e., a ribbon, cord, thong, etc.) through the loops 215, alternating from side to side, as is done when lacing shoelaces. This can give the garment the appearance of a corset. As can be understood, the user can modify spacing between the two clips 200 and the tension of the tying material by pulling the tying material 160 taut, to a desired tension. This design allows the user the ability to custom fit and change the appearance of any shirt, skirt, scarf, belt or wearable garment without compromising the original design of the garment. This method also allows the user to custom tailor a garment to a correct size without having to take in a seam.

Referring now to FIG. 6, as discussed above, instead of placing one cinch part on the inside of a garment and the other on the outside, the fabric can be folded or pulled to create a pleat or fold 144, and one clip part 110 or 120 being placed on the outside of the pleat or fold 144, with the other clip part 110 or 120 being placed within the pleat or fold 144, such that both parts 110, 120 are on the outside of the garment 140, but one faces out from the garment 140, while the other is concealed in the pleat or fold 144. The loops 115 on a pair of these clips 100 can be interlaced, as illustrated in FIG. 6, with an elongated tying material 160, in order to pull the pleats 144 towards one another.

After the elongated tying member 160, illustrated in FIGS. 6 and 7, is pulled to a desired level of tautness, and the clips are a desired distance apart, the free ends 160*a* of the elongated tying material 160 can be tied in a bow or knot, in order to maintain the clips 100, 200 at the set distance from one another, and the garment cinched, as desired.

One particular method of using a fashion accessory in accordance with one particular embodiment of the invention will now be described in connection with FIG. 7. Note that, although the method will be described using cinch clips 200, this is not meant to be limiting, as other geometrically shaped cinch clips, including the cinch clips 100, can be used in place of one or both cinch clips 200. First, the parts 210, 120 of the cinch clip 200 are separated from one another by sliding the magnets apart from one another, typically, along a longitudinal axis of the clip 200. A post 120 is then placed on the inside of the garment 240, or inside a dress, scarf, etc., with the magnet facing the front of the garment. Then, the clip body 210 is placed on the outside of the garment, with its magnet facing into the garment, in order to mate the two magnets, and thus the two cinch clip pieces. More particularly, the two aligned magnets will create a magnetic hold with fabric of the garment 240 in between. For best form fitting style, it is desirable to place the magnets far enough apart to offer a laced up appearance—i.e., the farther apart they are, the better they appear. The clips 200 placed as described, can then be interlaced together with a ribbon or string 160, and tied off, as described above.

Figure 8:
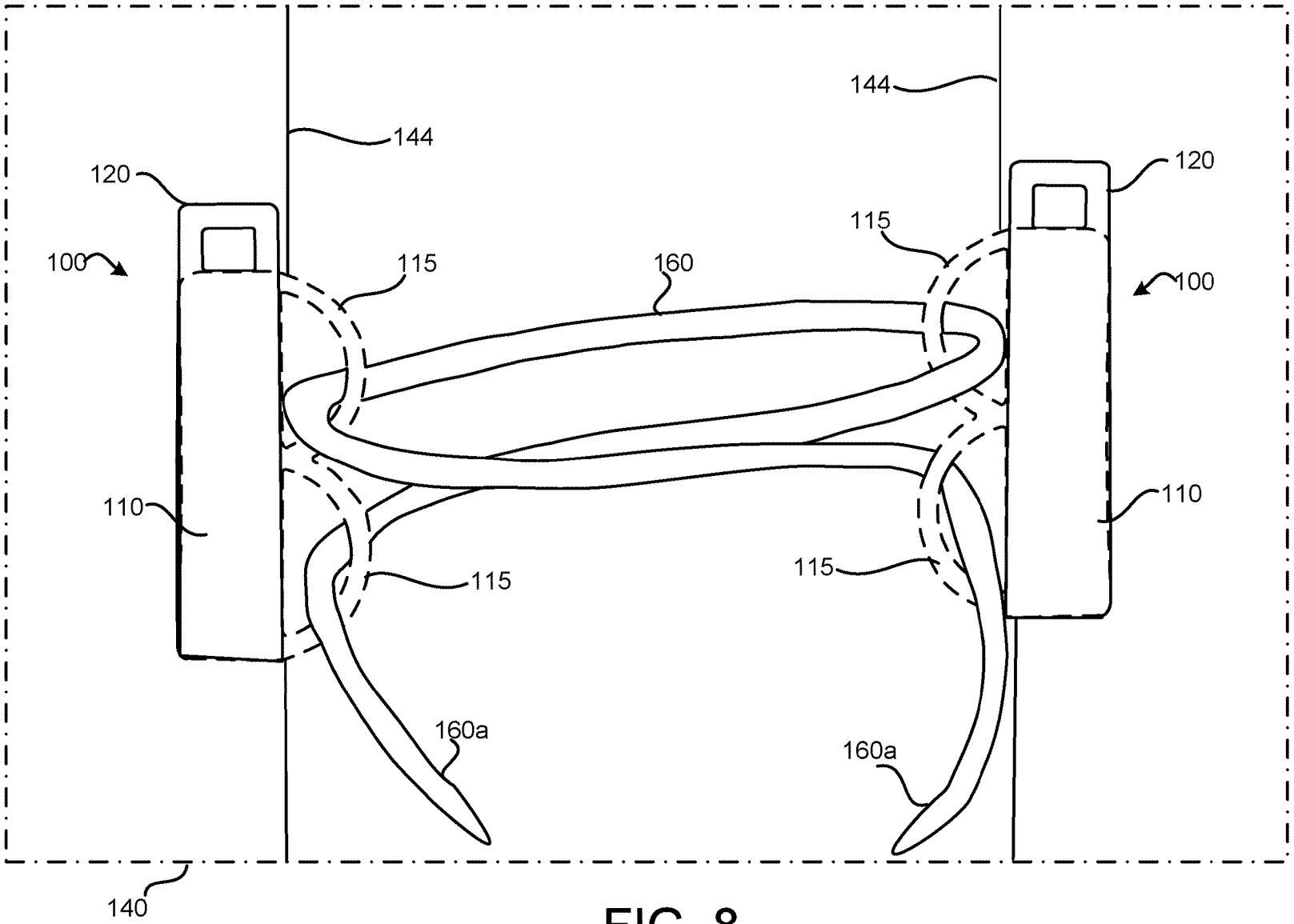
FIG. 8 illustrates a fashion accessory including at least two cinch clips attached to a garment, in accordance with a further particular embodiment of the invention.

In use, the cinch clips 100, 200 may be reversible, with looped body 110/210 facing outward, or the post 120 facing outward. Additionally, the pieces of the cinch clip 100, 200 can be hidden with the drape of a garment, if desired. For example, referring now to FIG. 8, a fashion accessory in accordance with one preferred embodiment of the invention is provided in which the body 110 of the cinch clip 100 is hidden in a pleat 144 of the fabric, but which still permits the lacing of the garment using the pair of cinch clips. In particular, in one embodiment, a one to two inch pleat 144 is formed in the fabric and held with a wearer's fingers. The post 120 is placed on the outside of the pleat 144. The clip body 110 is then placed on the inside of the pleat so that the fabric is folded and there is one part 110, 120 on each side of the fold, and with the loops 115 pointing out from the fold. The clip body 110 will hide in the fold 144. Repeat the foregoing with a second clip 100 on another part of the garment, such that the loops 115 of the two clips 100 face one another. Use any string or ribbon 160 to lace between the loops 115 of the two clips 100. Note that you may have to turn or flip one of the clip bodies 110, so that the loops 115 are facing each other from either end, in order to ensure that they are accessible to be laced up. Pull the string or ribbon 160 to the desired tautness and tie it off.

The cinch clip 100, 200 of the present invention can clip on to scarves to allow the user the ability to securely hold fabric in place while obtaining a desired look, and without damaging the fabric. Additionally, a fashion accessory, in accordance with the present invention, can be used to personally adapt the fit of a garment to a wearer, such as a person or a mannequin. Among other things, a fashion accessory, as described herein, can be used for scarves, skirts, shirts, bandanas, belts or any arts and crafts projects that require stabilization to another pliable component.

As can be seen from the foregoing, the fashion accessory including one or more multi-functional cinch clips as described in accordance with the present invention are used as a temporary, removable accessory that firmly attaches to fabric or another material without damaging or permanently altering the article to which it is attached. Additionally, although described herein as a fashion accessory, it should be understood that cinch clips according to the present invention can be used for arts and crafts, and other purposes. For example, the magnet is used for fastening to a desired project allowing the ability to attach and detach at will to any desired fabric or fixture, giving the user a flexibility of design options. Further, with the present invention, all components are advantageously reusable.

Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

The invention claimed is:

1. A fashion accessory, comprising:

a first cinch clip, including:

a clip body including a first lengthwise edge defined between shorter second and third end faces, said clip body including at least two closed loops both extending off from, and formed integral with, said first lengthwise edge of the clip body;

a post, separate from, and completely detachable from, said clip body, said post not being integrally formed with said clip body, said post including first and second elongated, lengthwise edges defined between shorter second and third end faces, said first and second lengthwise edges of said post not having loops extending therefrom; and at least one magnet arranged to hold said clip body together with said post with material between said clip body and said post.

2. The fashion accessory according to claim 1, wherein said at least one magnet is two magnets, a first of said two magnets being permanently fixed to said clip body and a second of said two magnets being permanently fixed to said post.

3. The fashion accessory according to claim 1, wherein said two closed loops are formed as semicircular closed loops extending from a base of said clip body.

4. The fashion accessory according to claim 1, wherein said two closed loops are formed as square loops extending from a side of a base of said clip body.

5. The fashion accessory according to claim 1, further comprising a decoration affixed to at least one of said clip body and said post.

6. The fashion accessory according to claim 5, wherein said at least one decoration is affixed to a front face of at least one of said clip body and said post.

7. A fashion accessory, comprising:

a first cinch clip, including:

a clip body including a first lengthwise edge defined between shorter second and third end faces, said clip body including at least one closed loop extending off from, and formed integral with, said first lengthwise edge of the clip body;

a post, separate from said clip body, said post not being integrally formed with said clip body, said post including first and second elongated, lengthwise edges defined between shorter second and third end faces, said first and second lengthwise edges of said post not having loops extending therefrom; and at least one magnet for holding said clip body together with said post with material between said clip body and said post;

a second cinch clip, including:

a clip body including a first lengthwise edge defined between shorter second and third end faces, said clip body including at least one closed loop extending off from, and formed integral with, said first lengthwise edge of the clip body;

a post, separate from said clip body, said post not being integrally formed with said clip body, said post including first and second elongated, lengthwise edges defined between shorter second and third end faces, said first and second lengthwise edges of said post not having loops extending therefrom;

at least one magnet for holding said clip body together with said post with material between said clip body and said post; and an elongate tying material laced between said at least one closed loop of said first cinch clip and said at least one closed loop of said second cinch clip in a spaced relationship.

8. The fashion accessory according to claim 7, wherein said at least one closed loop is at least two closed loops extending off from a base portion of each of said first clip body and said second clip body.

9. The fashion accessory according to claim 8, wherein said two closed loops are formed as semicircular closed loops extending from a base of said main body.

10. The fashion accessory according to claim 7, wherein said at least one magnet of each of said first cinch clip and said second cinch clip is two magnets, a first of said two magnets being permanently fixed to said main body and a second of said two magnets being permanently fixed to said post.

11. A fashion accessory, comprising:

a first cinch clip, including:

a clip body including a first lengthwise edge defined between shorter second and third end faces, said clip body including at least one closed loop extending off from, and formed integral with, said first lengthwise edge of the clip body;

a post, separate from said clip body, said post not being integrally formed with said clip body, said post including first and second elongated, lengthwise edges defined between shorter second and third end faces, said first and second lengthwise edges of said post not having loops extending therefrom; and at least one magnet arranged to hold said clip body together with said post with material between said clip body and said post; and an elongated tying material laced through said at least one closed loop and tied off at free ends of said elongated tying material.

12. The fashion accessory of claim 11, wherein said at least one closed loop is two closed loops extending from said clip body.

13. The fashion accessory according to claim 11, wherein said two closed loops are formed as semicircular closed loops extending from a base of said clip body.

* * * * *